US008803740B2

(12) United States Patent
Huang et al.

(10) Patent No.: US 8,803,740 B2
(45) Date of Patent: Aug. 12, 2014

(54) COMPOSITE ANTENNA STRUCTURE

(75) Inventors: Yueh-Pi Huang, Miaoli County (TW); Ming-Tsan Tseng, Tainan (TW); Ming-Yi Wu, Miaoli County (TW)

(73) Assignee: Inpaq Technology Co., Ltd., Miaoli County (TW)

( * ) Notice: Subject to any disclaimer, the term of this patent is extended or adjusted under 35 U.S.C. 154(b) by 305 days.

(21) Appl. No.: 13/343,014

(22) Filed: Jan. 4, 2012

(65) Prior Publication Data

US 2013/0169486 A1 Jul. 4, 2013

(51) Int. Cl.
*H01Q 1/38* (2006.01)

(52) U.S. Cl.
USPC ..... 343/700 MS

(58) Field of Classification Search
CPC ..... H01Q 1/243; H01Q 1/38; H01Q 1/40
USPC ..... 343/700 MS, 846
See application file for complete search history.

(56) References Cited

U.S. PATENT DOCUMENTS

| | | | | |
|---|---|---|---|---|
| 4,117,494 | A * | 9/1978 | Frazita | 343/844 |
| 4,733,245 | A * | 3/1988 | Mussler | 343/769 |
| 6,727,853 | B2 * | 4/2004 | Sasada et al. | 343/700 MS |
| 8,319,694 | B2 * | 11/2012 | Yang et al. | 343/725 |
| 2011/0165839 | A1 * | 7/2011 | Kawamura et al. | 455/41.1 |
| 2012/0162047 | A1 * | 6/2012 | Mizuno et al. | 343/905 |

* cited by examiner

*Primary Examiner* — Tho G Phan
(74) *Attorney, Agent, or Firm* — Li & Cai Intellectual Property (USA) Office

(57) ABSTRACT

A composite antenna structure includes a dielectric main body, a covering layer and a metallic transmission line structure. The dielectric constant of the dielectric main body is ranged from 1 to 200. The covering layer is disposed on the dielectric main body and has a pattern area defined thereon. The metallic transmission line structure is formed on the pattern area of the covering layer.

11 Claims, 8 Drawing Sheets

COMPOSITE ANTENNA STRUCTURE

BACKGROUND OF THE INVENTION

1. Field of the Invention

The present invention relates to an antenna structure. In particular, the present invention relates to a composite antenna structure.

2. Description of Related Art

For the development of wireless communication, wireless transmission/reception may be facilitated through the wireless hardware (e.g., modem, antenna, etc.) to transfer data. For example, individual apparatuses may operate to provide resources that assist users when engaging in audible and/or visible communication, managing schedules, obtaining desired information, etc. While applying for different environment, the antenna may be cataloged as external antennas and built-in antennas. In arrangement, the external antenna(s) is affixed to the exterior of a wireless communication device. On the contrary, the built-in antenna(s), such as chip antenna(s) is mounted on PCB and accommodated inside the wireless communication device.

The traditional manufacturing method of the chip antenna has disadvantages, for example, the transmission line is formed on ceramic body by a printing method. Due to the three-dimensional structure of the ceramic body, the printed transmission line cannot be precisely controlled, especially on the corner of the ceramic body. For example, the printed transmission line may have dis-connected issue. On the other hand, operators have to rotate the ceramic body while printing transmission line on multi surfaces of the ceramic body. Moreover, the ceramic body needs to be aligned to sure the connection between the transmission lines printed on different surfaces. Therefore, the antenna of the traditional manufacturing method is not precise and the manufacturing procedure takes much time.

SUMMARY OF THE INVENTION

One object of the instant disclosure is providing a composite antenna structure. The composite antenna structure has precise transmission line structure so as to improve the transmission quality of the antenna.

Another object of the instant disclosure is providing a composite antenna structure with small size.

The instant disclosure provides a composite antenna structure comprising: a dielectric main body with dielectric constant ranged from 1 to 200; a covering layer disposed on the dielectric main body, the covering layer having a pattern area defined thereon; and a metallic transmission line structure formed on the pattern area of the covering layer.

The instant disclosure provides a composite antenna structure comprising: a dielectric main body with dielectric constant ranged from 1 to 200; a covering layer disposed on the dielectric main body, the covering layer having a laser-modified area to expose the dielectric main body; and a metallic transmission line structure formed on the exposed surface of the dielectric main body.

By forming the metallic transmission line structure on the covering layer using laser technology or precise molding method, the precision of the metallic transmission line structure can be improved. In addition, the electrical properties of the dielectric main body can improve the performance of the antenna even when the size thereof is shrunk. In other words, the composite antenna structure can meet the requirements of electronic product having small size. Furthermore, the covering layer may provide for anti-vibration effect to improve the reliability of the antenna.

For further understanding of the present invention, reference is made to the following detailed description illustrating the embodiments and examples of the present invention. The description is for illustrative purpose only and is not intended to limit the scope of the claim.

DETAILED DESCRIPTION OF THE PREFERRED EMBODIMENTS

The present invention provides a composite antenna structure. By coating plastic materials on a dielectric main body and forming transmission line(s) on the plastic materials, the size of the manufactured antenna is reduced.

Figure 1:
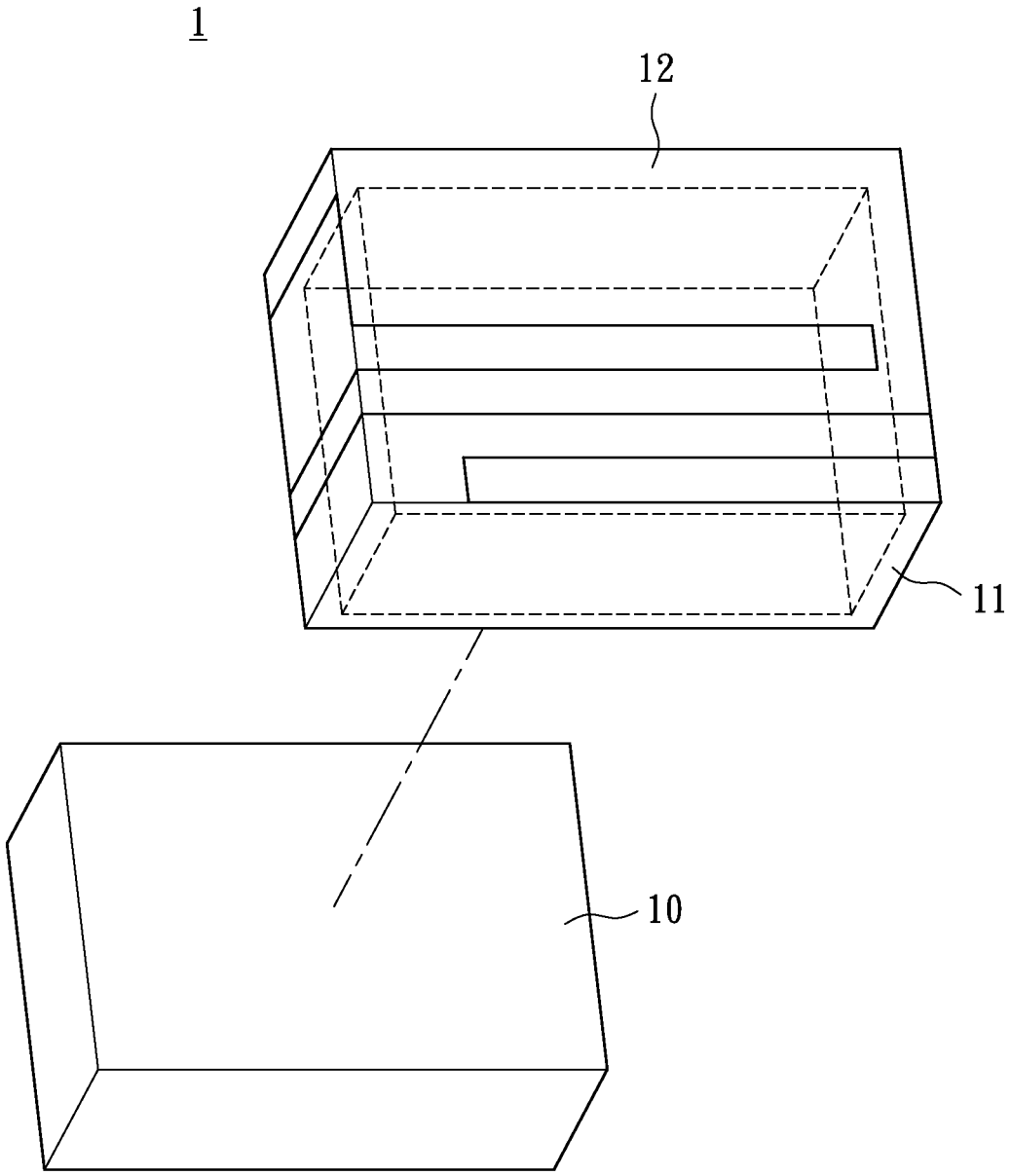
FIG. 1 shows the perspective view of the composite antenna structure of the instant disclosure.

Please refer to FIG. 1; the composite antenna structure 1 of the instant disclosure has a dielectric main body 10, a covering layer 11 and a metallic transmission line structure 12 formed on the covering layer 11. In one exemplary embodiment, the dielectric main body 10 is, but not restricted, made of aluminum oxide which is a main component of the composite antenna structure 1. The high electronic property of the main body 10 may be applied to the antenna to achieve the high transmission properties and the reduced antenna size. For example, the dielectric constant of the dielectric main body 10 may be ranged from 1 to 200.

On the other hand, the covering layer 11 is coated on the dielectric main body 10 so that the transmission line(s), i.e., the metallic transmission line structure 12 can be preferably formed on the covering layer 11. In the exemplary embodiment, the dielectric main body 10 with dielectric constant of 10 or 20 is coated by the plastic covering layer 11.

Figure 2:
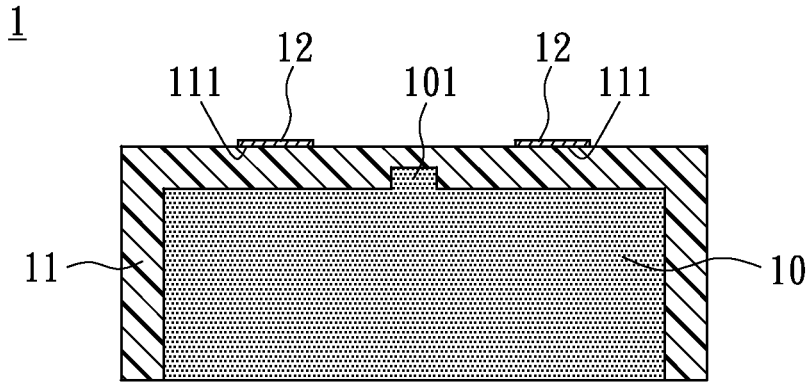
FIG. 2 shows a side view of the composite antenna structure of the first embodiment of the instant disclosure.
Figure 2A:
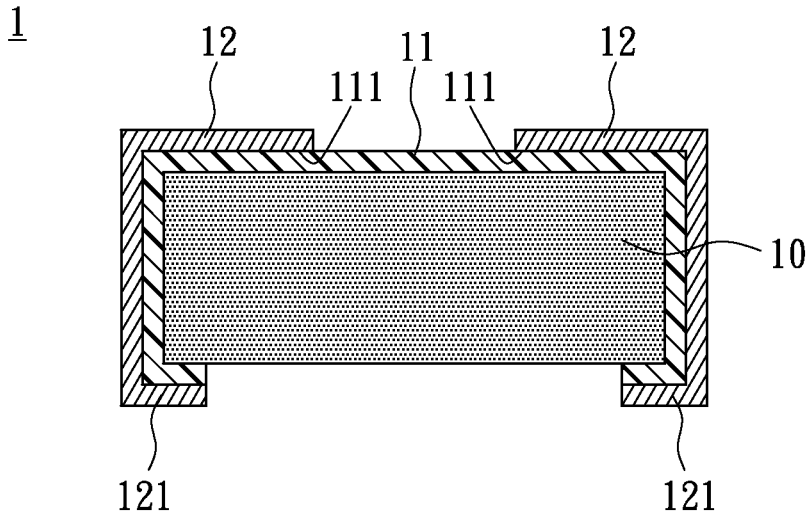
FIG. 2A shows a side view of the composite antenna structure of the alternative embodiment of the instant disclosure.

Please refer to FIGS. 2 and 2A; a method which is named as "laser direct structuring method, LDS method" may be applied for forming composite antenna structure 1 of the first embodiment. The covering layer 11 of specific plastic film doped with metal-organic complex is coated on the dielectric main body 10 and the metallic transmission line structure 12 can be formed on the laser-modified area of the covering layer 11 so as to receive/transmit the signals. In detail, the dielectric main body 10 is accommodated in a mold and then the a plastic material with doped particles of organic metal compounds is molded and fixed onto the dielectric main body 10 to form the covering layer 11. For example, the plastic materials may be polypropylene (PP) or polybutylene terephthalate (PBT) and the organic metal compounds can be organic compound of $Pd^{2+}$ or $Cu^{2+}$. Then, laser beam (i.e., coherent light) is applied to modify the predetermined pattern area 111 as a laser-modified area to activate the organic metal compounds and the exposed metal atoms may act as "nucleus" for subsequent metal-deposition processes. For example, an electro-less plating process is applied to deposit conductive materials, such as copper trace, nickel trace or gold trace on the predetermined pattern area 111 (i.e., the laser-modified area having activated metal nucleus) of the covering layer 11 and the deposited metal traces may act as "signal transmission path" (i.e., the metallic transmission line structure 12) to receive/transmit the wireless signals.

Please refer to FIGS. 1 and 2; the dielectric main body 10 a rectangular parallelopiped structure having a top surface, a bottom surface and four side surfaces connected between the top and the bottom surfaces. The molded covering layer 11 covers at least three surfaces of the rectangular parallelopiped structure. For example, the covering layer 11 covers the top surface and two of the four side surfaces of the dielectric main body 10. After the LDS method, the metallic transmission line structure 12 is formed on the predetermined pattern area 111 of the covering layer 11. On the other hand, the dielectric main body 10 further has a location structure 101 thereon, such as a pillar structure shown in FIG. 2 or a groove. The location structure 101 is used to notice the center of the dielectric main body 10 in the insert-molding process. Therefore, the molded covering layer 11 may preferably cover the surface of the dielectric main body 10.

Alternatively, the molded covering layer 11 covers the top surface, two of the four side surfaces and a part of the bottom surface of the dielectric main body 10. The deposited metallic transmission line structure 12 is formed on the top surface, the side surfaces and the bottom surface of the dielectric main body 10, and the metallic transmission line structure 12 formed on the bottom surface of the dielectric main body 10 can act as welding portions 121 which is a weldable connection structure. Therefore, the composite antenna structure 1 of the instant disclosure may be directly mounted onto a carrying board, for example a printed circuit board by using the welding portions 121.

Figure 2B:
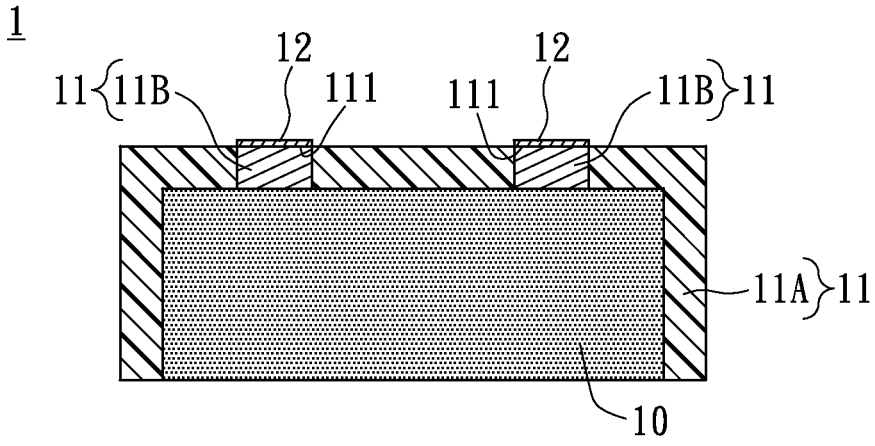
FIG. 2B shows a side view of the composite antenna structure of the second embodiment of the instant disclosure.

Another method which is named as "Two-component injection molding method" is applied for forming composite antenna structure 1 of the second embodiment. Please refer to FIG. 2B; two plastic materials are molded as the covering layer 11 on the dielectric main body 10. Two kinds of procedures may be executed to form the covering layer 11 of two plastic materials. One procedure is molding a first plastic material on a part of the dielectric main body 10 and the first plastic material can be catalyzed to deposit metals thereon. Then, the second plastic material is molded on the remaining part of the dielectric main body 10 and no metal can be deposited on the second plastic material. Therefore, after the surface modification and metal deposition, the metal layer (i.e., the metallic transmission line structure 12) is deposited on the catalyzed surface of the first plastic material. The other procedure is molding a first plastic material on a part of the dielectric main body 10 and the first plastic material can be catalyzed to deposit metals thereon. Then, etching and doping Pd ion on the surface of the first plastic material. Next, a second plastic material is molded on the remaining part of the dielectric main body 10. Therefore, after metal deposition, the metal layer (i.e., the metallic transmission line structure 12) is deposited on the catalyzed surface of the first plastic material. Accordingly, by the two-component injection molding method, the covering layer 11 is constructed by a first plastic portion 11A and a second plastic portion 11B. In other words, the dielectric main body 10 is coated by the first plastic portion 11A and the second plastic portion 11B. In the exemplary embodiment, the first plastic portion 11A is an insulation portion on which a metal material cannot be directed deposited and the second plastic portion 11B is a conductive portion on which the metal material can be directed deposited. As above-mentioned, the second plastic portion 11B can be made by a plastic material which can be metal-catalyzed or metal-doped and the surface of the second plastic portion 11B naturally defines the pattern area 111. Thus, the metallic transmission line structure 12 can be formed on the surface of the second plastic portion 11B. The mold used in the two-component injection molding method is designed to form the second plastic portion 11B so that the arrangement/shape of the second plastic portion 11B corresponds to the metallic transmission line structure 12. Therefore, the deposited copper layer or nickel layer on the surface of the second plastic portion 11B can be applied to transfer/receive signals.

Figure 3:
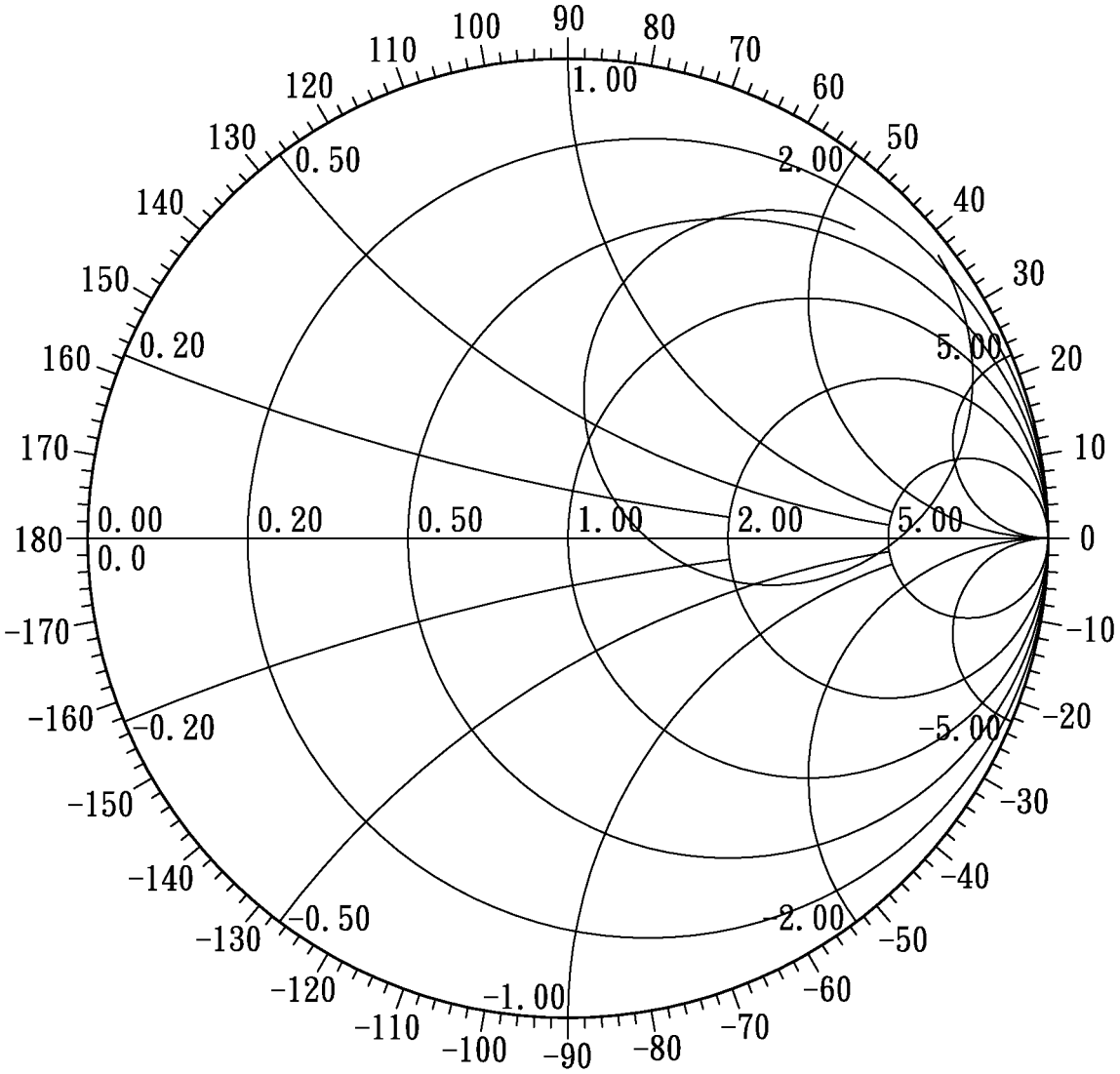
FIG. 3 shows a Smith chart of the composite antenna structure of the instant disclosure.
Figure 4:
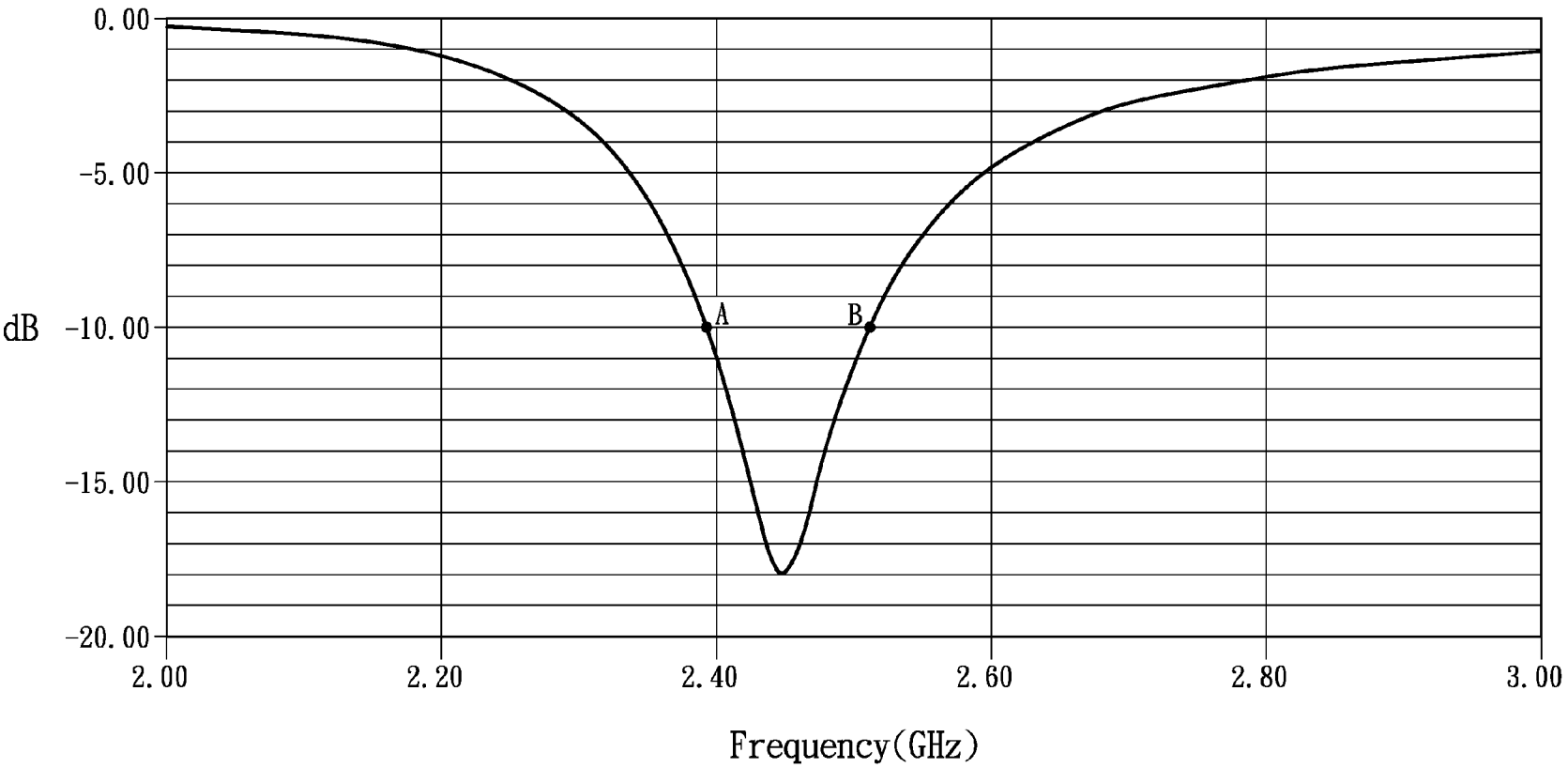
FIG. 4 shows an S11 curve of the composite antenna structure of the instant disclosure.
Figure 5:
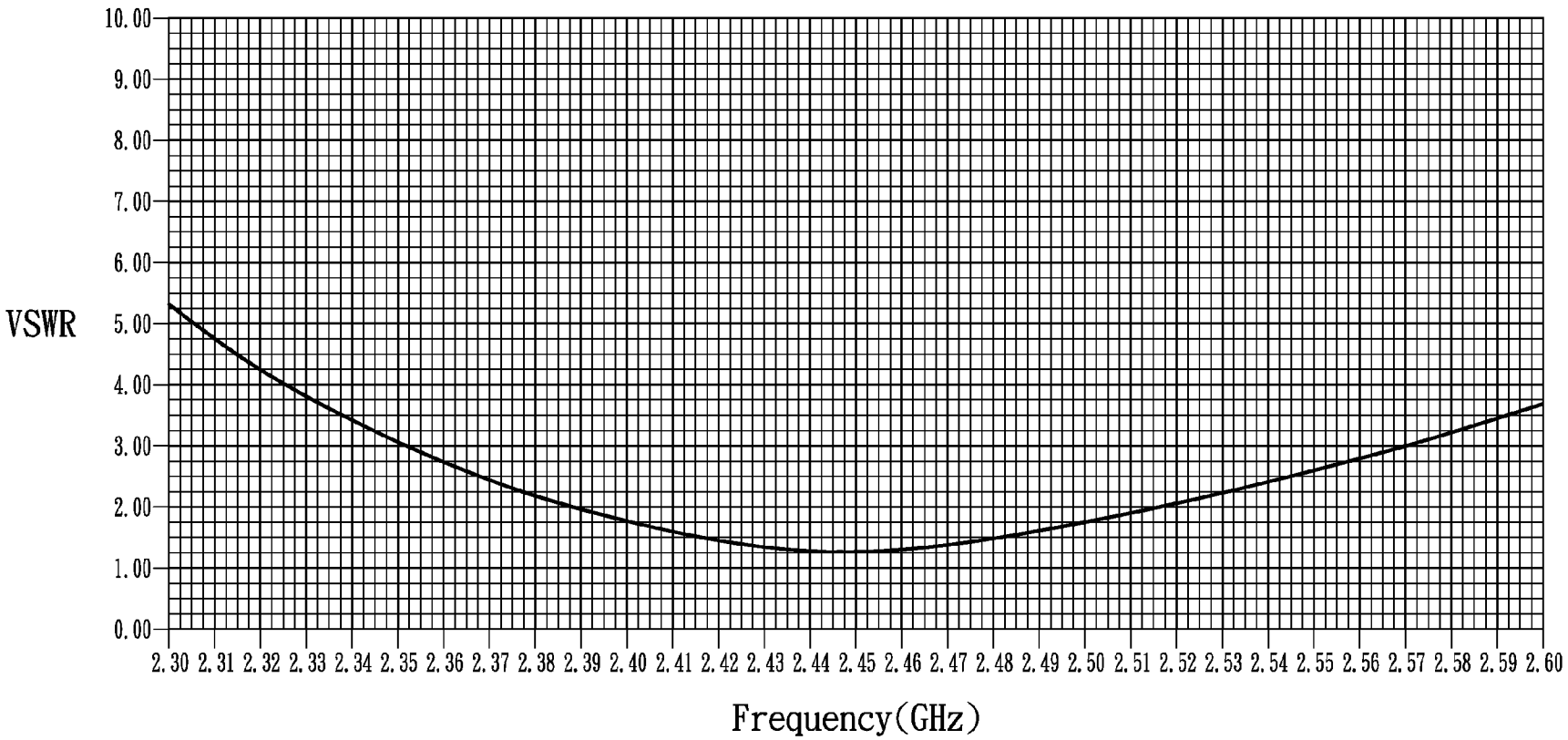
FIG. 5 shows a curve of the variation of VSWR to the frequency of the composite antenna structure of the instant disclosure.

To sum up, the plastic covering layer 11 coated on the dielectric main body 10 acts as an auxiliary layer to forming metallic transmission line structure 12 thereon. Moreover, the high dielectric property of the dielectric main body 10 may be applied to shrike the size of antenna. FIG. 3 illustrates a Smith chart of the composite antenna structure 1 of the first embodiment. FIG. 4 is an S11 curve of the composite antenna structure 1 of the first embodiment. The −10 dB point of the S11 curve is at approximately 2.39 GHz, i.e., point A (−10.01 dB, 2.39 GHz) and 2.51 GHz, i.e., point B (−10.07 dB, 2.51 GHz). FIG. 5 shows a curve of the variation of VSWR (voltage standing wave ratio) to the frequency of the composite antenna structure 1 of the first embodiment.

On the other hand, the following table 1 shows the comparison between the composite antenna structure 1 of the first embodiment and a traditional antenna. According to the result of "gain", although the value of the composite antenna structure 1 of the first embodiment is smaller than that of the traditional antenna, the difference therebetween will not take influence to the signal transmission. In other words, the composite antenna structure 1 has smaller size than the traditional antenna, but it can meet the requirement of signal-transmission application.

TABLE 1

| | center frequency | band weight | gain |
|---|---|---|---|
| traditional | 2455 MHz | 2390-2520 MHz | 3.06 dB |
| Instant invention | 2450 MHz | 2390-2510 MHz | 2.46 dB |

Figure 2C:
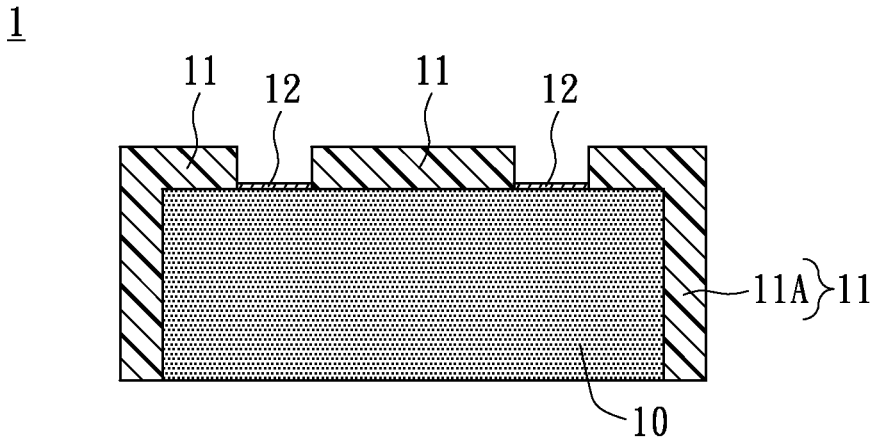
FIG. 2C shows a side view of the composite antenna structure of the third embodiment of the instant disclosure.

Please refer to FIG. 2C; the composite antenna structure 1 of the third embodiment is shown. The method for manufacturing the composite antenna structure 1 of the second embodiment has the following steps. Similarly to the first embodiment, the plastic covering layer 11 is molded on the dielectric main body 10. Then, a laser beam is used to partially remove the plastic covering layer 11 having specific patterns corresponding to the pattern area 111 and then an etch method is used to remove the patterned area of the plastic covering layer 11 to expose the surface of the dielectric main body 10. Therefore, the exposed area of the dielectric main body 10 is the pattern area 111. Next, the electro-less method is used to deposit copper layer, nickel layer or gold layer on the exposed area of the dielectric main body 10 to form the metallic transmission line structure 12. In this embodiment, the metallic transmission line structure 12 may extend from the surface of the plastic covering layer 11 to the dielectric main body 10.

Figure 6:
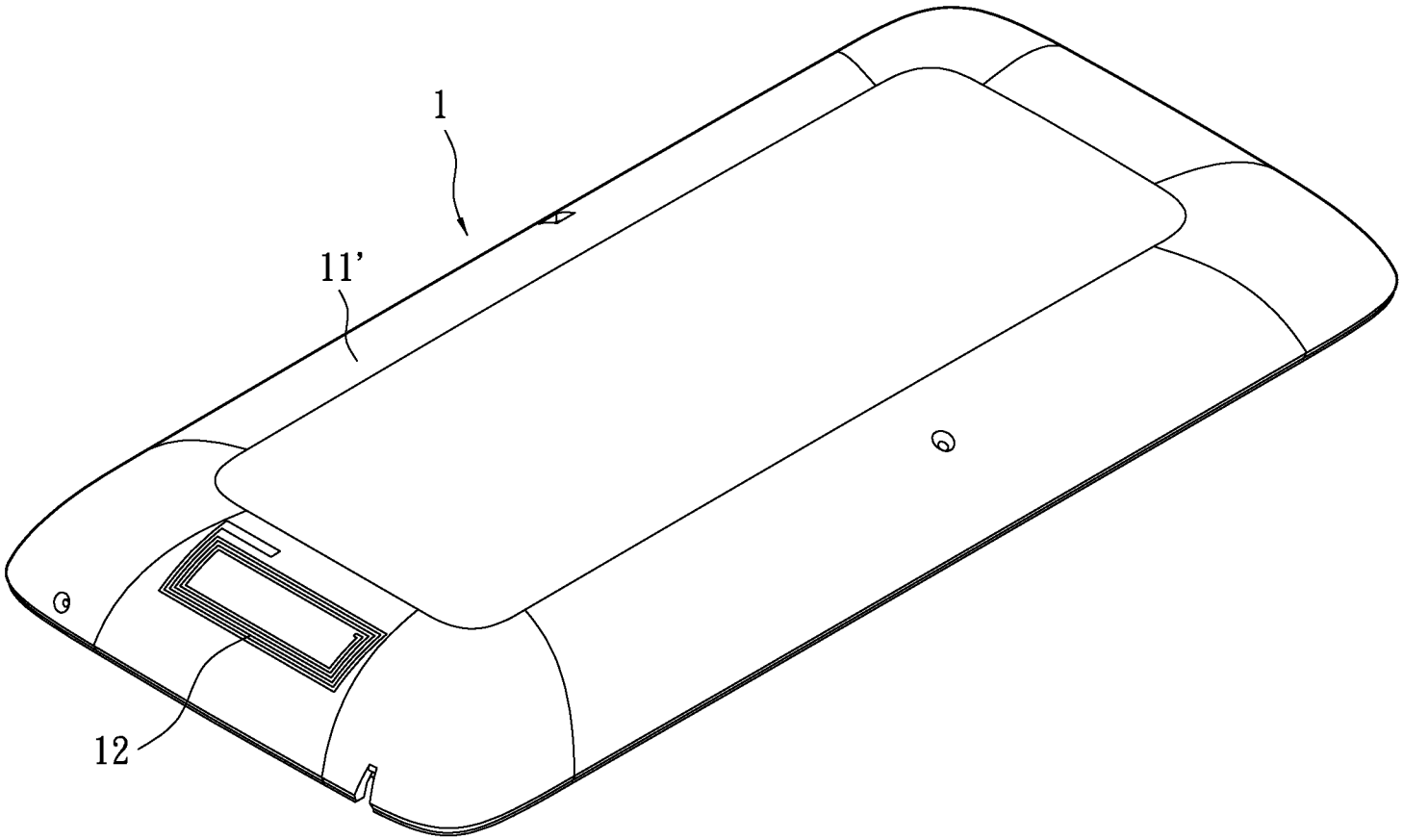
FIG. 6 shows the perspective view of the composite antenna structure of the forth embodiment of the instant disclosure.
Figure 6A:
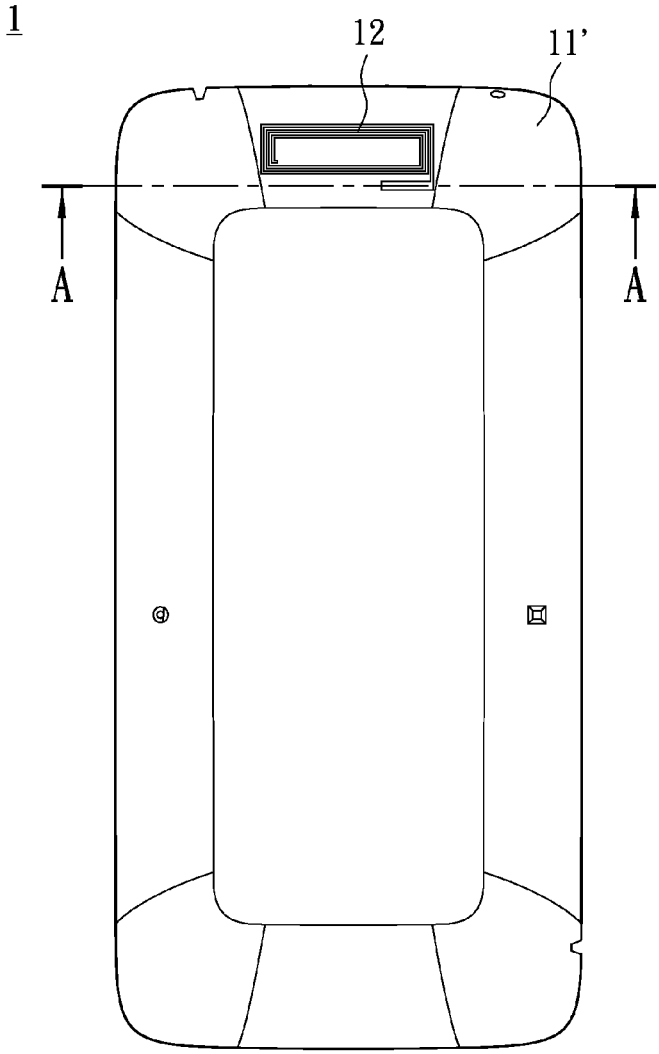
FIG. 6A shows the top view of the composite antenna structure of the forth embodiment of the instant disclosure.
Figure 6B:
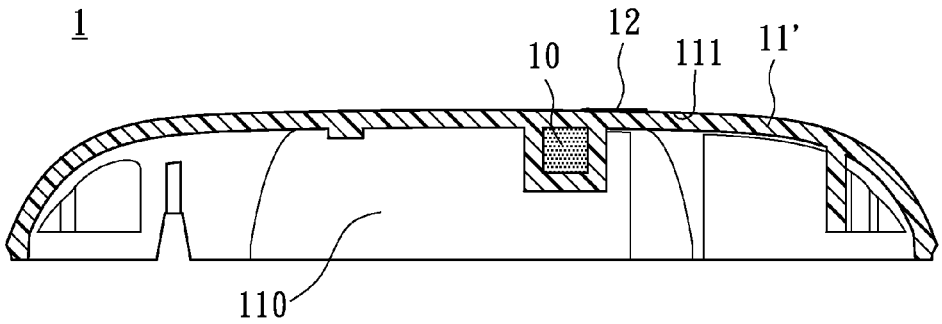
FIG. 6B shows the side view of the composite antenna structure of the forth embodiment of the instant disclosure.

Please refer to FIGS. 6 thru 6B; the composite antenna structure 1 can have specific shape, such as a back cover of a mobile device. In FIG. 6, the shape of the plastic covering layer 11 does not correspond to the dielectric main body 10. By the above-mentioned LDS method, a plastic material with doped particles of organic metal compounds is molded as an outer casing (i.e., the covering layer 11) and simultaneously the dielectric main body 10 is covered by the molded outer casing. After being activated by a laser beam, the metallic transmission line structure 12 can be formed on the laser-modified area of the outer casing. As shown in FIG. 6A, the metallic transmission line structure 12 formed on the laser-modified area is a zigzag-shaped line. On the other hand, the outer casing has a receiving space thereinside to accommodate PCB(s) or electronic component(s). The dielectric main body 10 is covered by the outer casing and located in the receiving space. Furthermore, a protection member (not shown) is coated on the metallic transmission line structure 12. For example, a resin is coated on or sprayed onto the metallic transmission line structure 12. Alternatively, a protection cover is attached or locked on the metallic transmission line structure 12 so as to protect the metallic transmission line structure 12.

The present invention at least has the following characteristics.

1. The present invention may have higher manufacturing efficiency. The procedures of coating/molding the covering layer on the dielectric main body and forming metallic transmission line structure on the covering layer are operated by automatic apparatus. Thus, the manufacturing time and cost may be reduced.

2. Because the covering layer is coated on the dielectric main body, the properties of the dielectric main body may improve the radiation efficiency even when the size of the antenna is shrunken. On the other hand, the plastic material of the covering layer has lighter weight comparing with the ceramic or metal; thus, the weight of the composite antenna may be reduced. Still further, the plastic material of the covering layer can absorb the vibration so that the reliability of the instant antenna is improved.

3. The LDS method or the two-component injection molding method can be used to precisely define complex pattern on the covering layer, such as patterns with bending portion or corner portion. Thus, the metallic transmission line structure can be a complex and precise radiation structure. The non-precision issue of the traditional printing method can be solved.

4. The present invention may be used to manufacturing several kinds of antenna, such as chip antenna or back cover antenna.

The description above only illustrates specific embodiments and examples of the present invention. The present invention should therefore cover various modifications and variations made to the herein-described structure and operations of the present invention, provided they fall within the scope of the present invention as defined in the following appended claims.

What is claimed is:

1. A composite antenna structure comprising:

a dielectric main body with dielectric constant ranged from 1 to 200;

a covering layer disposed on the dielectric main body, the covering layer having a pattern area defined thereon; and a metallic transmission line structure formed on the pattern area of the covering layer;

wherein the dielectric main body is a ceramic body, the covering layer is a plastic film doped with metal-organic complex, and the pattern area is a laser-modified area exposed to a laser.

2. The composite antenna structure as claimed in claim 1, wherein the dielectric main body is a rectangular parallelopiped structure having a top surface, a bottom surface and four side surfaces connected between the top and the bottom surfaces, the covering layer covers at least three surfaces of the rectangular parallelopiped structure.

3. The composite antenna structure as claimed in claim 2, wherein the covering layer covers the top surface and two of the four side surfaces of the rectangular parallelopiped structure.

4. The composite antenna structure as claimed in claim 2, wherein the covering layer covers the top surface, two of the four side surfaces and a part of the bottom surface of the rectangular parallelopiped structure.

5. The composite antenna structure as claimed in claim 1, wherein the dielectric main body further has a location structure thereon.

6. The composite antenna structure as claimed in claim 1, wherein the metallic transmission line structure has a weldable connection structure.

7. The composite antenna structure as claimed in claim 1, wherein the covering layer is formed as an outer casing.

8. The composite antenna structure as claimed in claim 7, wherein the outer casing has a receiving space thereinside, and the dielectric main body is covered by the outer casing and located in the receiving space.

9. The composite antenna structure as claimed in claim 1, wherein the metallic transmission line structure extends from the surface of the covering layer to the dielectric main body.

10. A composite antenna structure comprising:

a dielectric main body with dielectric constant ranged from 1 to 200;

a covering layer disposed on the dielectric main body, the covering layer having a laser-modified area to expose the dielectric main body; and a metallic transmission line structure formed on the exposed surface of the dielectric main body.

11. A composite antenna structure comprising:

a dielectric main body with dielectric constant ranged from 1 to 200;

a covering layer disposed on the dielectric main body, the covering layer having a pattern area defined thereon; and a metallic transmission line structure formed on the pattern area of the covering layer;

wherein the covering layer is constructed by a first plastic portion and a second plastic portion, the first plastic portion is an insulation portion on which a metal material cannot be directed deposited, the second plastic portion is a conductive portion on which the metal material is directed deposited, and the pattern area is defined on the surface of the second plastic portion.

* * * * *